United States Patent [19]

Vollmar

[11] Patent Number: 4,476,796

[45] Date of Patent: Oct. 16, 1984

[54] UPPER CLOTH FEED IN A SEWING MACHINE

[75] Inventor: Kurt Vollmar, Kaiserslautern, Fed. Rep. of Germany

[73] Assignee: Pfaff Industriemaschinen GmbH, Fed. Rep. of Germany

[21] Appl. No.: 374,514

[22] Filed: May 3, 1982

[30] Foreign Application Priority Data

May 18, 1981 [DE] Fed. Rep. of Germany ..... 3119716

[51] Int. Cl.[3] ..... D05B 27/04

[52] U.S. Cl. ..... 112/320

[58] Field of Search ..... 112/320, 315

[56] References Cited

U.S. PATENT DOCUMENTS 3,757,714 9/1973 Gustmann et al. ..... 112/320
3,927,629 12/1975 Vollmar ..... 112/320
4,285,294 8/1981 Aida ..... 112/320 X

FOREIGN PATENT DOCUMENTS 2057450 6/1971 Fed. Rep. of Germany .

*Primary Examiner*—Warner H. Schroeder
*Assistant Examiner*—Andrew M. Falik
*Attorney, Agent, or Firm*—McGlew and Tuttle

[57] ABSTRACT

An upper cloth feed in a sewing machine comprises a presser foot and an upper cloth feed foot, each connected over a linkage with a feeding and lifting drive. The drive is connected over a connecting member with a substantially vertically moving carrier for the presser foot. A spring acts on the connecting member, and an idle stroke connection is provided inside the lifting drive. For the adjustable distribution of the pressure force on the two sewing feet, the force of the spring acting on the substantially horizontally moving connecting member is variable. In order to obtain a simple constructional design, the spring presses over a pressure rod on a pressure piece mounted for displacement on the connecting member.

13 Claims, 3 Drawing Figures

Fig. 1
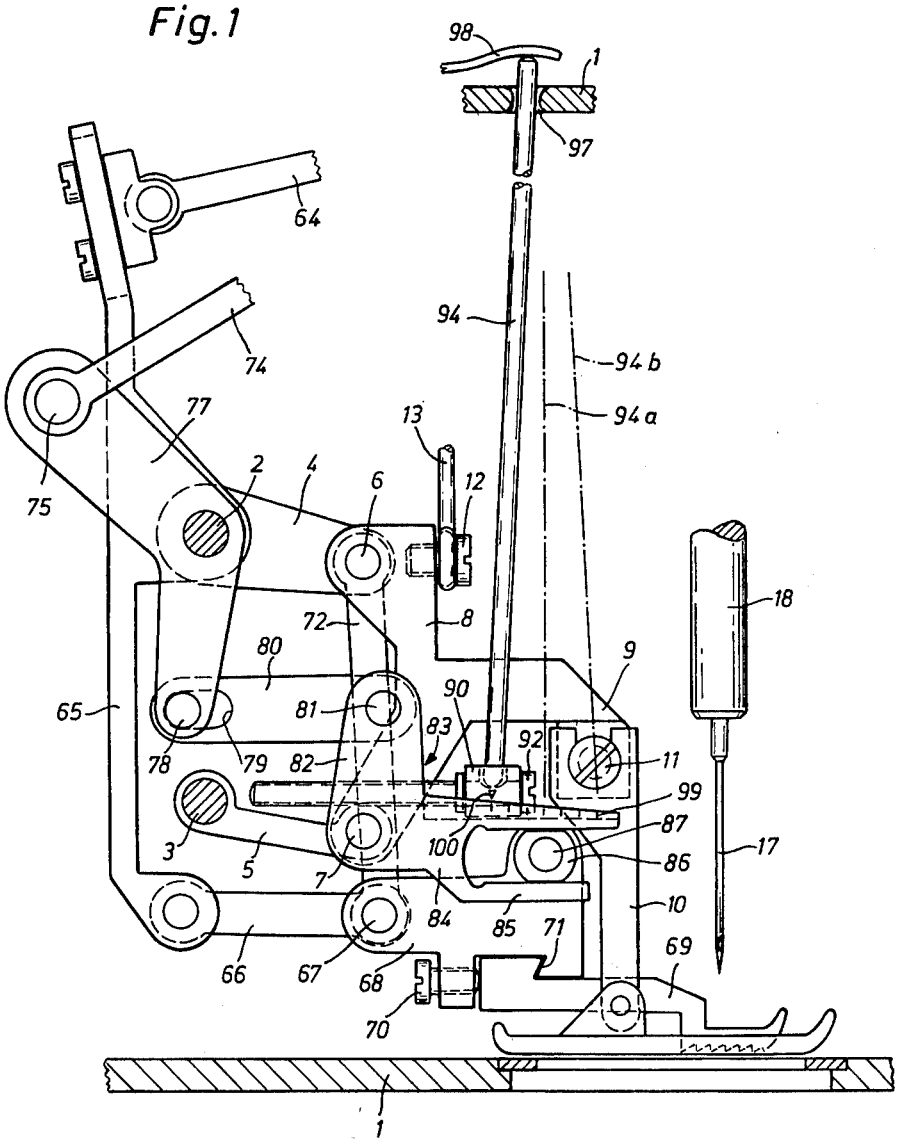
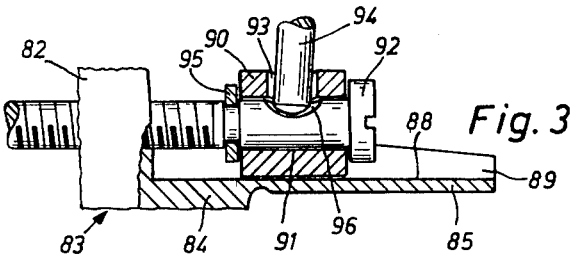
Fig. 3

UPPER CLOTH FEED IN A SEWING MACHINE

FIELD AND BACKGROUND OF THE INVENTION

The present invention relates in general to sewing machines and in particular to a new and useful upper cloth feed for a sewing machine which has adjustable tensioning means for applying a variable degree of tension to an upper cloth feed foot and a cloth pressure foot.

Upper cloth feeds for sewing machines are known which include a pressure foot and an upper feed foot which is connected over rods to a feeding and lifting drive. In such an upper feed device (as shown in German OS No. 20 57 450), one compression spring acts on the feed foot and another acts on the driving connection between the upper feed foot and the presser foot. Due to the idle stroke existing between the lifting drive and the presser foot, the presser foot remains likewise on the sewing material during the advance phase of the sewing material in which the upper feed foot bears on the sewing material. In the resting phase of the sewing material, the upper feed foot is lifted from the sewing material by the lifting drive.

Due to this procedure, both compression springs stress the presser foot in the resting phase of the sewing material, while in the moving phase one compression spring stresses the upper feed foot, and the other compression spring stresses the presser foot.

The known arrangement has the disadvantage that a desired distribution of the pressure forces on the upper feed foot and the presser foot, as is required for the proper sewing of different materials, is very cumbersome and can only be achieved by several readjustments of the two compression springs.

Even when replacing the existing upper feed foot by one with a different working range, such a readjustment of the pressure forces on the two sewing feet is necessary. Upper feed feet with soles that work ahead or in the range of the needle are suitable for differential sewing operations, while for sewing material layers of equal length, upper feed feet with soles that work behind the needle are provided. When replacing such feet with a different working range, the pressure distribution therefore changes likewise, and must be readjusted. If this readjustment is very elaborate, an exact material adjustment is frequently foregone or is only made incompletely, and the result shows corresponding drawbacks.

SUMMARY OF THE INVENTION

The present invention is based on the problem of providing a solution for the pressure distribution over the two sewing feet of the upper feed which is simple in design and easy to operate.

Accordingly an object of the present invention is to provide an upper cloth feed in a sewing machine which comprises a presser foot, an upper feed foot, feeding and lifting drive means connected to the presser foot and the feed foot for lifting and lowering the presser foot and feed foot and for moving the feed foot horizontally to feed cloth, a vertically movable carrier connected to the presser foot over a horizontally extending connecting member, biasing means bearing on the connecting member for biasing the connecting member downwardly and adjustment means connected to the biasing means for adjusting the relative biasing force applied to the presser foot and to the feed foot.

Consequently only the pressure of a single spring may act on the two sewing feet, so that the total load and its distribution over the two sewing feet can be very easily adjusted.

A further object of the invention is to provide such a cloth feeding device wherein a single spring is utilized as biasing means which is transmitted over a rod to a pressure piece slidably mounted to the connecting member. The position of the pressure piece on the connecting member is adjustable and selectively positionable by a screw threaded into a vertical arm of the connecting member.

In addition, the distribution of the pressure force on each of the two sewing feet can be adjusted very easily, since the adjusted pressure ratios can be recognized by the position of the pressure pieces.

A still further object of the invention is to provide a bore in the pressure piece for receiving the pressure rod and an indentation in the screw for receiving an end of the rod so that the screw can be rotated by increments of 360° to adjust the position of the pressure piece. Due to this arrangement, the action of the spring is ensured in a simple manner against shifting by vibrations during operation of the sewing machine A still further object of the invention is to provide such an upper cloth feed device wherein the carrier of the upper feed foot is connected with the carrier of the presser foot, at one end over a moving lever joint and at another end over a pair of guide rods. A still further object of the invention is to provide such an upper feed device wherein the carrier of the presser foot forms the connecting rod of a parallelogram linkage system whose base is connected to a casing of the sewing machine with the carrier of the feed foot connected by joints to the connecting rod.

A still further object of the invention is to provide an upper cloth feed device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings:

FIG. 1 is a front elevational view of the sewing machine according to the invention, whose head cover has been removed;

FIG. 3 is an enlarged representation of the shifting device for the action of the spring, partly in section.

DESCRIPTION OF THE PREFERRED EMBODIMENT

Figure 2:
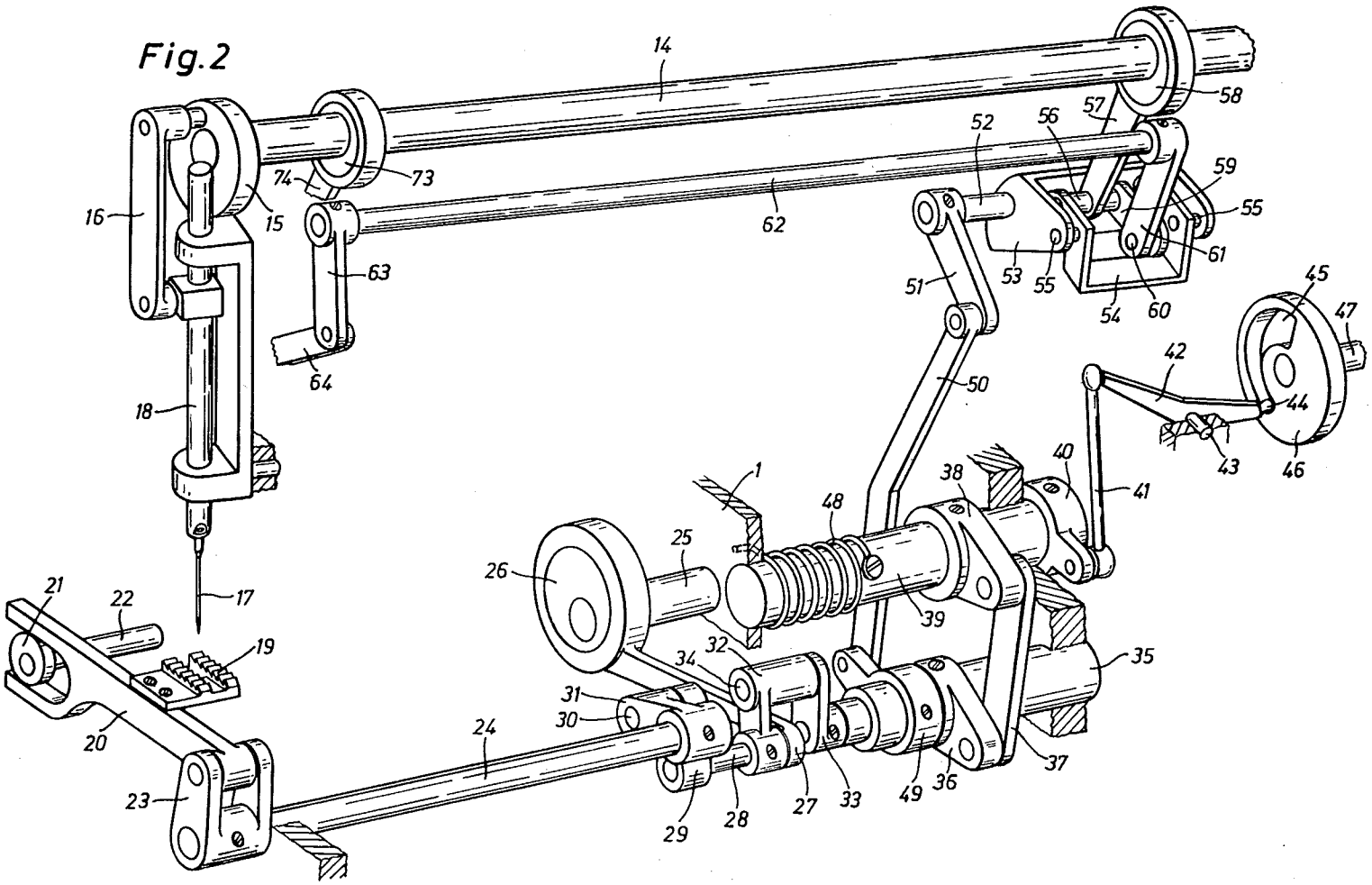
FIG. 2 is a perspective view of the drive for driving the feeding tools of the sewing machine according to the invention.

Referring to the drawings in particular, the invention embodied therein in FIG. 1, comprises an upper cloth feed device for a sewing machine having a casing 1 to which is secured two bolts 2 and 3 on which are mounted two levers 4 and 5, having equal lengths.

A connecting rod 8 is connected with lever arms 4 and 5 over hinge pins 6 and 7. Connecting rod 8 has an arm 9 for securing a presser foot 10 by a screw 11. A bar 13 is engaged in connecting rod 8 by means of a screw 12, which bar is connected with a known swivel lever (not shown), that is secured on the casing for lifting or lowering connecting rod 8.

As shown in FIG. 2, a main shaft 14 is also mounted in casing 1 and is driven in known manner. The main shaft 14 drives a needle bar 18 equipped with a needle 17, over a crank 15 and a guide rod 16.

A lower cloth feed 19 is received by a carrier 20, whose forked end embraces an eccentric 21 which is arranged on a shaft 22 mounted in casing 1 and which imparts to cloth feed 19 one stroke per stitch-forming operation. The other end of carrier 20 is connected with a forked crank 23 which is secured on a shaft 24, likewise mounted in casing 1. For driving shaft 24 an eccentric 26, whose eccentric rod 27 is hinged on journal 28, is secured on a shaft 25 extending parallel to shaft 22 and in operating connection with it. On this journal 28 is mounted a guide rod 29 which is connected by means of journal 30 with a crank 31 secured on shaft 24. Laterally of eccentric rod 27 a guide rod 32 is secured on journal 28 which embraces a journal 34 carried by a crank 33. As can be seen from FIG. 2, the effective length of guide rod 32 is equal to the effective length of guide rod 29, so that, when the two journals 30 and 34 are aligned with each other, shaft 24 remains stationary, despite the moving eccentric rod 27.

For varying the movement of eccentric rod 27 acting on shaft 24, crank 33 is clamped on an adjusting shaft 35 mounted in casing 1, which additionally carries an adjusting crank 36. The crank 36 is connected over an intermediate member 37 and another adjusting crank 38 with an intermediate shaft 39 mounted in casing 1, on the free end of which is clamped a lever 40. Lever 40 is connected over a ball joint-pull rod 41 with one end of a swivel lever 42, which can be swiveled about an axis 43 secured in the casing. The free end of swivel lever 42 has a spherical shoulder 44 and protrudes into an adjusting cam 45 of a lockable adjusting wheel 46 which is arranged on an axle 47 fixed in the casing. Adjusting cam 45 in adjusting wheel 46 extends in a spiral to its axle 47 in such a way that stitch lengths of 1 to 6 mm length can be adjusted on the lower cloth feed 19. A spring 48 surrounding intermediate shaft 39 and secured at one end on casing 1, keeps shoulder 44 of swivel lever 42 constantly bearing on one of the slide walls of adjusting cam 45.

On adjusting shaft 35 is clamped an adjusting crank 49 which connects a guide rod 50 with a lever arm 51, which is secured on an adjusting shaft 52 mounted in casing 1. A yoke 53 is secured on adjusting shaft 52 between the arms of which is rotatably mounted another yoke 54 by means of journals 55. The arms of yoke 54 are connected by a bolt 56 on which is hinged an eccentric rod 57. An eccentric 58, secured on arm shaft 14 is enclosed by eccentric rod 57. Eccentric 58 imparts to bolt 56 oscillating movements about journals 55.

A guide rod 59 acting at one end on bolt 55 is hinged at the other end by means of a journal 60 on a lever arm 61 which is secured at one end of a swing shaft 62 mounted in casing 1 parallel to arm shaft 14. To the other end of swing shaft 62 is connected a lever arm 63 which is connected over a guide rod 64 (FIG. 1), to one arm of a double-arm lever 65 mounted on bolt 2. The other arm of lever 65 acts over a guide rod 66 on a hinge pin 67, on which is mounted a carrier 68 for an upper cloth feed 69. Cloth feed 69 is secured by a screw 70 through a clamping joint 71 on carrier 68. Hinge pin 67 on carrier 68 is carried by a pair of guide rods 72 mounted on hinge pin 6.

An eccentric 73, is secured on main shaft 14 (FIG. 2), which is embraced by an eccentric rod 74. The free end of eccentric rod 74 is connected by a journal 75 (FIG. 1) to one arm of a double lever 77 mounted on pin 2. The other arm of double lever 77 carries a journal 78 which protrudes into an oblong slot 79 of a guide rod 80. The guide rod 80 is connected by means of a bolt 81 to one arm 82 of an angle lever 83, which is mounted in hinge pin 7 of lever arm 5, and whose free arm forms a connecting member 84 between connecting rod 8 and carrier 68. To this end, connecting member 84 has a fork 85 in which is guided a bushing 86 provided with parallel faces, which is mounted on a journal 87 secured in carrier 68.

Fork 85 (FIG. 3) has on its upper forked arm a sliding surface 88 which is defined by two guide walls 89 protruding laterally upwardly. In between is guided a pressure piece 90. The pressure piece 90 is provided with a bore 91 for receiving a screw 92, and with another bore 93 for receiving one end of a pressure rod 94. The axial position of pressure piece 90 on screw 92 is secured by a locking washer 95. Screw 92 is provided on the part of its shaft mounted in pressure piece 90 with a depression 96 extending parallel to its axis. It is screwed into a threaded bore in arm 82 of angle lever 83.

Pressure rod 94 (FIG. 1) is guided with its free end in a guide bore 97 of casing 1. A leaf spring 98 secured in casing 1 presses pressure rod 94 down. One guide wall 89 has a scale 99 which cooperates with a marking 100 on pressure piece 90.

The arrangement works as follows:

The adjustment of the size of the feed of the upper cloth feed 69 and of the lower cloth feed 19 is effected jointly by turning adjusting wheel 46 so that adjusting cam 45 turns intermediate shaft 39 over swing lever 42 correspondingly.

Intermediate shaft 39, over intermediate member 37, shifts the adjusting shaft 35, and over guide rod 50 and lever arm 51, the adjusting shaft 52. This arrangement has the effect that when adjusting wheel 46 is shifted, the feed adjustment of the lower cloth feed 19 is changed in synchronism with the feed adjustment of the upper cloth feed 69.

The movement derived from eccentric 26 is transmitted over the driving connection, eccentric rod 27, journal 28, guide rod 29, journal 30, crank 31, shaft 24, forked crank 23, to the lower cloth feed 19, which thus performs its feeding movement.

The movement derived from eccentric 58 is transmitted to the upper cloth feed foot 69 over the driving connection, eccentric rod 57, bolt 56, guide rod 59, journal 60, lever arm 61, swing shaft 62, lever arm 63, guide rod 64, lever 65, guide rod 66, journal 67, carrier 68, which thus performs a feed movement which is synchronous in size and direction with the lower cloth feed 19.

In synchronism with the feed movement of upper cloth feed foot 69, the movement derived from eccentric 73, arranged on main shaft 14, is transmitted over the driving connection, eccentric rod 74, journal 75, double lever 77, guide rod 80, bolt 81, angle lever 83 to carrier 68 and thus to upper cloth feed foot 69 as a lever movement. Upper cloth feed foot 69 is raised and lowered in the correct rhythm with its feeding movement.

During the return movement of double lever 77, journal 78 rises from its bearing in longitudinal slot 79, after upper cloth feed foot 69 has been placed on the sewing material, and performs a movement which has no effect on guide rod 80. Due to this measure, upper cloth feed foot 69 is lifted, when positioned to the left in FIG. 1, when the downwardly pointing lever arm of double lever 77 is turned, since angle lever 83 bears over hinge pin 7 and connecting rod 8 on presser foot 10.

The pressure of leaf spring 98 exerted over pressure rod 94 and pressure piece 90 on angle lever 82 is then fully transmitted over hinge pin 7 and connecting rod 8 to pressure foot 10.

When turning the lower lever arm of double lever 77 to the right in FIG. 1, journal 78 rises from its stop in oblong slot 79 after upper cloth feed foot 69 has been placed on the sewing material. Presser foot 10 thus remains on the sewing material, even after upper cloth feed foot 69 has been attached. The pressure of leaf sping 98 is then distributed, corresponding to the adjusted position of pressure piece 90 both over upper cloth feed foot 69 and presser foot 10. The portions of the pressure forces conducted to presser foot 10 and to upper cloth feed foot 69 correspond then approximately to the ratio of the distances of pressure piece 90 from hinge pin 7 and a vertical line passing through the bearing range of the sole of upper cloth feed foot 69, since the lifting drive no longer acts on angle lever 83 due to the idle stroke connection between journal 78 and oblong slot 79. When pressure piece 90 is moved in the direction of this vertical line, (positions 94*a* or 94*b*), the pressure on upper cloth feed foot 69 is increased, and the pressure on presser foot 10 is correspondingly decreased. Inversely, when pressure piece 90 is moved in the direction of hinge pin 7, the pressure on upper cloth feed foot 69 is reduced and the pressure on presser foot 10 is correspondingly increased. This results in an indirect proportional pressure adjustment of upper cloth feed foot 69 relative to presser foot 10 in a change of the position of pressure piece 90.

This pressure distribution of the force of leaf spring 98 is only effective during the feeding phase of the sewing machine. In the lifting phase of upper cloth feed foot 69, the entire pressure of leaf spring rests on presser foot 10.

Screw 92 is turned to adjust the pressure distribution between upper cloth feed foot 69 and presser foot 10. With each rotation of 360°, the bottom end of pressure rod 94 engages depression 96. The turning of screw 92 is thus effected in steps, but these are sufficiently small, due to the low pitch of the screw thread. The locking prevents accidental movement of the screw by vibrations during the operation of the sewing machine. Marking 100 indicates in connection with scale 99, the position of pressure piece 90, and thus the ratio of the distribution of the force of leaf spring 98 over upper cloth feed foot 69 and pressure foot 10.

While a specific embodiment of the invention has been shown and described in detail to illustrate the application of the principles of the invention, it wiil be understood that the the invention may be embodied otherwise without departing from such principles.

What is claimed is:

1. An upper cloth feed device for a sewing machine having a casing comprising:

an upper feed foot having a vertically and horizontally moving carrier;

first drive means connected to said feed foot carrier for moving said feed foot carrier in the cloth feed direction by a selected distance;

a presser foot having a vertically movable carrier;

second drive means connected to said feed and presser foot carriers for raising and lowering said carriers, said second drive means having a connecting member connecting said feed and presser foot carriers with a surface extending between and across at least one of a first linkage connecting said second drive means with said presser foot carrier and a second linkage connecting said second drive means to said feed foot carrier;

a spring for biasing said connecting member downwardly to bias said feed and presser foot downwardly by selected forces; and position adjustment means for interengaging said spring with said surface at selected locations on said surface for adjustably distributing the biasing force of said spring to said feed foot and presser foot respectively.

2. A device according to claim 1, wherein said position adjustment means comprise a substantially vertically extending rod connected between said spring and said surface, a pressure piece slidably mounted on said surface and fixable at a selected position on said surface.

3. A device according to claim 2, wherein said connecting member includes a vertically extending arm and a horizontally extending arm, said feed foot carrier slidably engaged with said horizontally extending arm, a screw threaded into said vertically extending arm and engaged with said pressure piece for adjusting the location of said pressure piece on said surface.

4. A device according to claim 3, wherein said pressure piece includes an opening therein for receiving an end of said horizontally extending rod, said screw having an indentation at a circumferential location thereon corresponding to said opening for receiving the horizontally extending rod end.

5. A device according to claim 4, wherein said horizontally extending arm of said connecting member is in the form of the fork having upper and lower prongs, said upper prong having defined thereon said surface, a scale on said upper prong and a mark on said pressure piece cooperating with said scale to indicate the position of said pressure piece on said surface, said feed foot carrier having a bushing connected thereto slidably engaged between said prongs of said fork.

6. A device according to claim 1, including idle stroke means in the connection between said second drive means and said feed and presser foot carriers for lifting said presser and feed carriers only after a selected amount of motion by said first drive means.

7. A device according to claim 6, wherein said connecting member has a vertically extending arm and a horizontally extending arm, said horizontally extending arm carrying said surface, said second drive means including a rod extending connected to said horizontally rod and a lever pivotally mounted to said housing, said rod having a slot therein extending in a direction of motion of said lever and said lever having a pin engaged in said slot, said slot and pin forming said idle stroke means.

8. An upper cloth feed device for a sewing machine having a casing comprising:

an upper feed foot (69) having a vertically and horizontally moving carrier (68);

first drive means (64 to 66) connected to said feed foot carrier for moving said feed foot carrier (68) in a cloth feed direction by a selected distance;

a presser foot (10) having a vertically movable carrier (8);

second drive means (74 to 80) connected to said feed and presser foot carriers for raising and lowering said carriers, said second drive means having a substantially horizontally arranged connecting member (84) connecting said feed and presser foot carriers;

a spring (98) for biasing said connecting member (84) downwardly to bias said feed and presser foot downwardly by selected forces;

support means (90) slidably mounted on said connecting member; and position adjustment means (92) for adjustably fixing said support means at selected locations on said connecting member for adjustably distributing the biasing force of said spring to said feed foot and presser foot respectively.

9. An upper cloth feed device according to claim 8, characterized in that the force of the spring (98) is transmitted by a pressure rod (94) to said support means (90).

10. An upper cloth feed device according to claim 9, characterized in that said support means comprises a pressure piece (90), said pressure piece being carried by a screw (92) which is adjustable in a vertical arm of said connecting member (84), said screw (92) forming said position adjusting means.

11. An upper cloth feed device according to claim 10, characterized in that the pressure rod (94) protrudes through a bore (93) of the pressure piece (90) and that the screw (92) has on a part of its circumference a depression (96) provided in the range of the bore (93).

12. An upper cloth feed device according to claim 11, characterized in that the carrier (68) of the upper cloth feed foot (69) is connected to the carrier (8) of the presser foot (10), at one end by a moving lever joint (82 to 85), and at the other end by a guide rod (72).

13. An upper cloth feed device according to claim 12, characterized in that the carrier (8) of the presser foot (10) forms the connecting rod of a parallelogram linkage system (4, 5, 8) whose base is a casing (1) of the sewing machine, and that the carrier (68) of the upper feed foot (69) is connected by joints (6) and (7) of the connecting rod (8).

* * * * *